US006802163B2

(12) United States Patent
Hackman et al.

(10) Patent No.: US 6,802,163 B2
(45) Date of Patent: Oct. 12, 2004

(54) PLANT-ON BUILDING ENHANCEMENT

(76) Inventors: William Hackman, 179 Moore La., Arroyo Grande, CA (US) 93420; Marshall Lundberg, 2446 Willow Rd., Arroyo Grande, CA (US) 93420

( * ) Notice: Subject to any disclaimer, the term of this patent is extended or adjusted under 35 U.S.C. 154(b) by 0 days.

(21) Appl. No.: 10/378,729

(22) Filed: Mar. 3, 2003

(65) Prior Publication Data

US 2004/0172902 A1 Sep. 9, 2004

(51) Int. Cl.[7] ..... E04F 13/00

(52) U.S. Cl. ..... 52/311; 52/309; 52/656.8; 52/211; 52/795.1

(58) Field of Search ..... 52/311.1, 656.8, 52/309.1, 211, 204.53, 795.1

(56) References Cited

U.S. PATENT DOCUMENTS

| | | | | | |
|---|---|---|---|---|---|
| 2,465,871 | A | | 3/1949 | Hardie et al. | 72/17 |
| 3,073,066 | A | | 1/1963 | Edwards et al. | 50/83 |
| 3,333,379 | A | * | 8/1967 | Harris | 52/364 |
| 3,740,911 | A | | 6/1973 | O'Leary | 52/388 |
| 4,773,199 | A | | 9/1988 | Kohara | 52/426 |
| 4,793,586 | A | | 12/1988 | Buss | 249/15 |
| 5,022,206 | A | * | 6/1991 | Schield et al. | 52/455 |
| 5,103,601 | A | * | 4/1992 | Hunt | 52/12 |
| 5,465,539 | A | * | 11/1995 | Rose | 52/204.53 |
| 5,551,204 | A | * | 9/1996 | Mayrand | 52/795.1 |
| 5,611,183 | A | | 3/1997 | Kim | 52/426 |
| 5,625,986 | A | * | 5/1997 | Mansfield et al. | 52/255 |
| 5,685,116 | A | | 11/1997 | Bradshaw et al. | 52/311.1 |
| 5,791,116 | A | | 8/1998 | Skintzis | 52/41.4 |
| 6,164,037 | A | | 12/2000 | Passeno | 52/749.11 |
| 6,360,505 | B1 | | 3/2002 | Johns | 52/311.1 |
| D456,528 | S | | 4/2002 | Maylon et al. | D25/121 |
| 6,591,566 | B1 | * | 7/2003 | Rodlin | 52/311.1 |
| 6,662,513 | B2 | * | 12/2003 | Rodlin | 52/255 |
| 2001/0012555 | A1 | | 8/2001 | Miller et al. | 428/156 |
| 2002/0023399 | A1 | | 2/2002 | Belleau | 52/254 |

* cited by examiner

*Primary Examiner*—Peter M. Cuomo
*Assistant Examiner*—Erika Garrett
(74) *Attorney, Agent, or Firm*—Law Office of Philip A Steiner

(57) ABSTRACT

A plant-on is disclosed that saves labor and material cost in producing a raised belly band decorative relief for a masonry building. The plant-on reduces labor costs as it may be applied to the structure by a single person. It is designed for direct application of the masonry materials such as stucco to the plant-on, without requiring waterproofing, providing further labor cost saving. It is also economical in the use of masonry materials to plant-on the band by limiting the volume available, and it may be customized to provide a variety of profiles. The plant-on is constructed of composite or polymeric materials which resists water damage and wood destroying insect pests.

27 Claims, 4 Drawing Sheets

PLANT-ON BUILDING ENHANCEMENT

CROSS-REFERENCE TO RELATED APPLICATIONS

Not Applicable

FEDERALLY SPONSORED RESEARCH AND DEVELOPMENT

Not Applicable.

REFERENCE TO A MICROFICHE APPENDIX

Not Applicable.

FIELD OF INVENTION

The present invention relates generally to an article of manufacture in the construction industry and more specifically to a plant-on which is attached to a structure and coated with a cementitious or masonry material such as stucco, plaster, concrete, mortar or adobe.

BACKGROUND

The use of masonry materials, called stucco, as surface coating for homes and commercial structures is well established, particularly in the sunbelt regions of the United States. Stucco is a finish that can be varied in surface texture and color used in applying the surface coat of stucco. The desire to have a building that is architecturally interesting and pleasing leads to the application of decorative features to the stucco in addition to pleasing surface textures and colors. A wide variety of decorative features are available. To name a few, the features may include simulated quoins, corner stones, stone borders and keystones around doors, windows or garage doors, raised decorations such as medallions, cornices, half columns, column caps, pot shelves, belly bands and brackets. A common decorative addition is the use of a raised belly band or plant-on to accent a building, often by laterally encircling the walls of a building with this decorative relief.

In the relevant art, plant-ons for use as structural enhancements are typically constructed from lengths of wood planks or more recently from polymeric foam materials. Wooden plant-ons are nailed to the side of the building prior to the preparation of the building wall for finish installation. During the preparation for installation the plant-on or plank receives special attention to seal the plank with waterproof paper and to apply metal screen or lath to which the masonry materials adheres. This plant-on is costly in materials and in labor.

Plant-ons made from polymeric foam materials are available in a variety of profiles and lengths. Foam plant-ons are considered superior to wood in being more impervious to water and termite damage but requires special handling during installation and is difficult to customize. Care must be taken during installation of the foam to prevent damage to the visible surfaces of the foam. In addition, fiberglass mesh must be applied by hand to allow adhesion of the masonry materials. Foam plant-ons are also difficult to customize due to the lack of interlocking mechanisms. Stacking and/or widening of foam plant-on becomes increasingly difficult due to the inability to easily attach one foam plant-on to another, thus becoming a two or more person task.

U.S. Pat. No. 5,685,116 to Bradshaw describes a plant-on manufactured of expanded metal lath. The patent teaches the application of the metal lath plant-on directly to the building wall, or to the building wall with a backing of waterproof paper. This saves labor in that the plant-on may be applied to the building wall after preparation of the flat wall surfaces for installation of the siding. The open metal lath has disadvantages in that it is relatively expensive.

There is a large open volume within the plant-on. The plant-on will fill, at least partially, with the masonry material as it is applied which may cause surface cracking over time due to the excessive weight. The patent teaches the use of waterproof paper as backing within the plant-on. Paper has the disadvantage of being flexible and placing the paper about the plant-on, without adhering it to the plant-on, makes it likely that the paper will move away from the plant-on when the masonry materials are applied. The patent further teaches the use of hot glue for adhering the paper backing to the plant-on. This is a potential problem, as the stucco must surround the metal in order to obtain good adherence. In addition, the application of hot glue is time consuming and labor intensive which could impact overall construction costs and completion schedule.

Therefore, what is needed is a low-cost plant-on that requires little to no preparation at the building site other than attachment to the building, is economical in the use of building siding material, and is easily attached to the building by one person.

SUMMARY

OBJECTS AND ADVANTAGES

One object of this invention is to provide a decorative band to a building that is attractive.

A second object of this invention is to provide a decorative band to a building that is inexpensive to manufacture.

A third object of this invention is to provide a decorative band to a building that is simple to install.

A fourth object of this invention is to provide a decorative band to a building that is made of materials that are relatively impervious to water.

A fifth object of this invention is to provide a decorative band to a building that is made of materials that wood-damaging insects will not affect.

A sixth object of this invention is to provide a decorative band to a building that is easily manufactured in varying dimensions and shapes.

A seventh object of this invention is to provide a decorative band that is easily customized.

This invention addresses the limitations described above and provides a plant-on which requires little to no preparation before installation and allows easy customization of raised architectural reliefs on buildings. The term building as used in this specification is used in its broadest sense and refers to both commercial and residential structures.

The plant-on invention is comprised of an elongated top section having a first end, a second end, a reticulated top outer surface, a reticulated top inner surface, a front side and a rear side. The top surface is joined to an elongated front side section having a reticulated front side outer surface, a reticulated front side inner surface, a first top portion and a first bottom portion.

The first bottom portion includes a plurality of front base sections and a plurality of vertically recessed front sections such that a front height of the first bottom portion varies periodically a pre-determined amount along a long dimension of the front side section.

The plant-on invention further includes an elongated rear side section having a reticulated rear side outer surface, a reticulated rear side inner surface, a second top portion joined to the rear side of the top section and a second bottom portion. The second bottom portion includes a plurality of rear base sections and a plurality of vertically recessed rear sections such that a rear height of the second bottom portion varies periodically the pre-determined amount along a long dimension of the rear side section and in concert with the front base sections.

The plant-on invention further includes a plurality of flanges having a vertical height less than the pre-determined amount and joined perpendicularly to at least the front and rear base sections and aligned in a plane generally parallel to the top inner surface. The periodic variations in the heights of the front and rear base sections allows flanges associated with another plant-on to intercalate with the plant-on when aligned in a side-by-side arrangement.

A plurality of attachment clips are disposed periodically along a long dimension of the elongated top, front side and rear side sections which allows the vertically stacking of another plant-on aligned along a centerline of the long dimension, or offset from a centerline of the long dimension. Another set of horizontal attachment clips are disposed on vertical surfaces at about the first and second ends of the plant-on for horizontally connecting another plant-on aligned along a centerline of the long dimension such that each of the connected plant-ons are uniformly aligned in an end-to-end arrangement. The plurality of attachment clips also allows attachment of a wire mesh which covers at least a portion of either front or and rear side sections. The attachment clips are highly scissile and excess or unused attachment clips may be removed before application of a masonry coating or simply left in place.

A plurality of substantially vertical partitions are perpendicularly joined to the inner surfaces of the plant-on and periodically spaced along a long dimension of the elongated top, front side and rear side sections.

The plant-on invention may be constructed from either a composite wood matrix or polymeric materials and in a variety of pre-determined shapes. The profile of the plant-on may include polygon features, elliptical features or any combination of polygon and elliptical features. The reticulated surfaces are generally porous to masonry materials such as cement, plaster, stucco and adobe which allows an interior volume to be at least partially filled with the masonry materials.

BRIEF DESCRIPTION OF DRAWINGS

The features and advantages of the invention will become apparent from the following detailed description when considered in conjunction with the accompanying drawings. Where possible, the same reference numerals and characters are used to denote like features, elements, components or portions of the invention. It is intended that changes and modifications can be made to the described embodiment without departing from the true scope and spirit of the subject invention as defined in the claims.

DETAILED DESCRIPTION

Embodiments of the customizable building plant-on are shown in FIGS. 1 through 9. The plant-on invention is a prefabricated unit constructed of either polymeric or composite wood materials. The composition of the polymeric materials may vary to obtain the desired properties of strength, impact resistance and adherence properties of the intended masonry materials. In one embodiment of the invention, the polymeric material is polyvinyl chloride PVC formed by an injection molding process. In another embodiment of the invention, the polymeric material is polypropylene. In the composite wood embodiment, wood chips are mixed with a binding matrix such as high temperature glue and molded to form the plant-on. Another embodiment of the invention incorporates carbon fibers to improve structural integrity. The outer surfaces of the plant-on may include an etched finish to improve adherence of the masonry materials.

Figure 1:
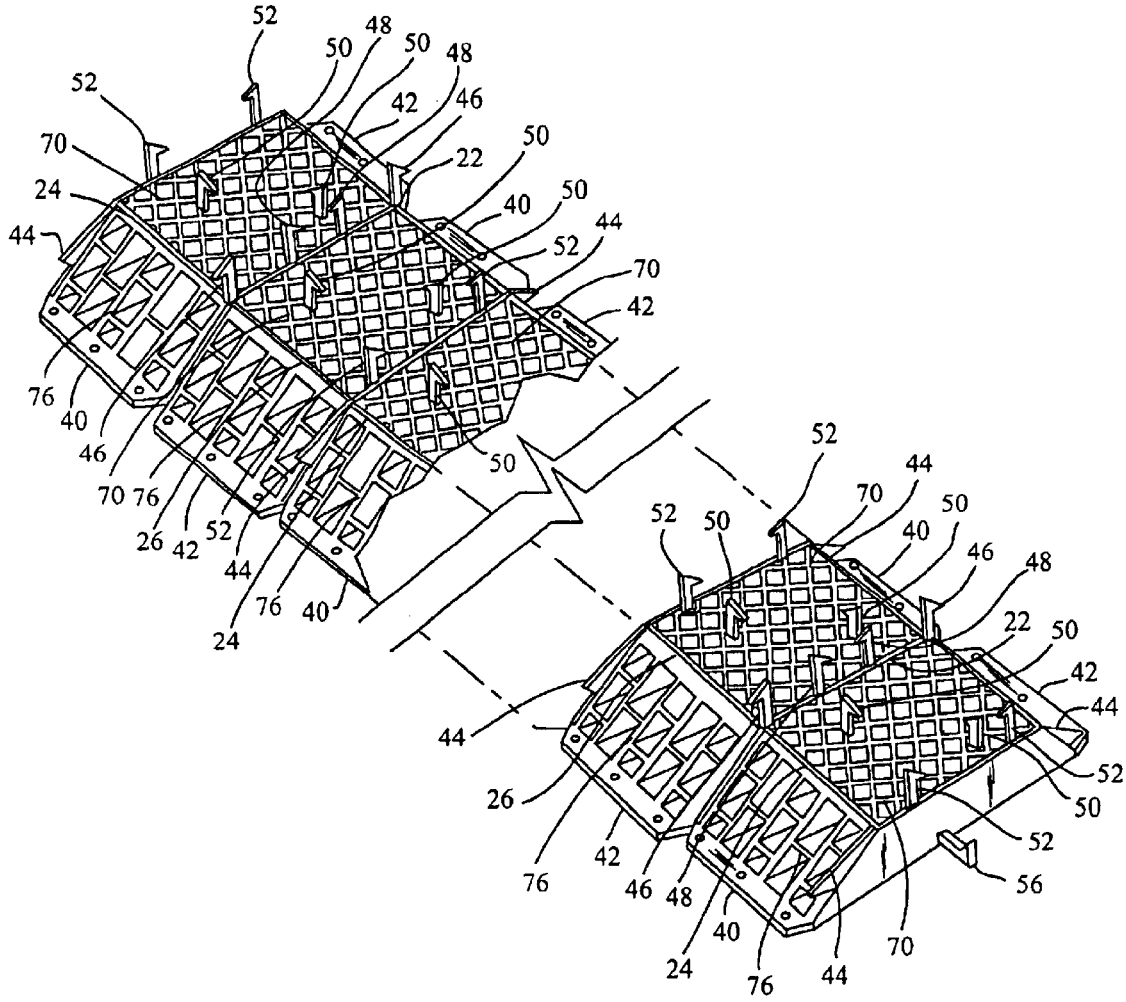
FIG. 1—FIG. 1 depicts a perspective view of the building enhancement invention.

Referring to FIG. 1, a perspective view of the invention is shown including a reticulated top section 70 having a series of vertically aligned attachment clips 46, 48, 50, 52 installed periodically about the surface of the top section. A set of offset stacking clips 48 are used to attach another plant-on to the top section of the plant-on aligned along a long dimension and offset uniformly from a centerline of the plant-on; a set of modular stacking clips 46 is used to attach another plant-on to the top section of the plant-on aligned along a long dimension and uniformly aligned on the centerline of the plant-on; and a set of upper and lower wire mesh attachment clips 52, 44 which are used to secure a wire mesh about the surface of the top 70 and side sections 24, 26. Wire mesh should be installed over the plant-on to achieve the desired shape rather than that provided by the plant-on alone.

The side sections 24, 26 are divided by a series of vertical partitions 22. The side sections are reticulated 76 and includes tall side sections 24 alternating periodically with a series of short side sections 26. Nailing flanges 40, 42 are attached at the bottoms of the side sections 24, 26 and aligned to parallel a generally planar surface. The flanges 40 attached to the taller side sections 24 are aligned with the bottommost portions of the plant-on. The flanges 42 attached to the shorter side sections 26 are vertically offset from the bottommost portions of the plant-on and forms periodic gaps between an intended mounting surface and a bottom of the flanges 42. The periodic gaps alternate in concert with those on the opposite side, but out of phase which allows two or more plant-ons to be positioned uniformly in a side-by-side arrangement without requiring offsetting of the plant-ons in the long dimension. The height of the gaps formed by the vertical offsets are generally greater than a thickness of the flanges 40 attached to the taller side sections 24. One or more lateral attachment clips 56 are provided on at least one of the vertical partitions 22 installed at an end of the plant-on. The lateral attachment clips are used to attach another plant-on in an end-to-end arrangement uniformly aligned along the centerlines of the long dimensions of the plant-ons.

A series of lower wire mesh attachments clips 44 are provided periodically along both sides of the plant-on. The lower wire mesh attachments clips 44 are used in conjunction with the upper wire mesh attachments clips 52 to secure a wire mesh to the plant-on. Lastly, a series of end corner bead attachment clips 50 are installed periodically on the top surface 70 of the plant-on. The end corner bead attachment clips 50 are staggered on other side of the centerlines of the long dimensions of the plant-ons to allow placement of corner bead over the ends of the plant-ons. A plurality of the end corner bead attachment clips 50 are provided to allow for placement of corner bead over plant-ons which have been cut to fit a particular installation arrangement. The modular stacking clips 46 are disposed such that opposing modular stacking clips have a width slightly larger than the interior width of the plant-on. The offset stacking clips 48 are disposed such that opposing offset stacking clips have a width slightly larger than the width of the nailing flanges 40, 42. All of the attachment clips are resilient which allows flexing and interlocking with wire mesh and other engaged plant-ons. The height, width and shape of the attachment clips may be varied to accommodate different manufacturing processes and installation requirements.

Figure 1A:
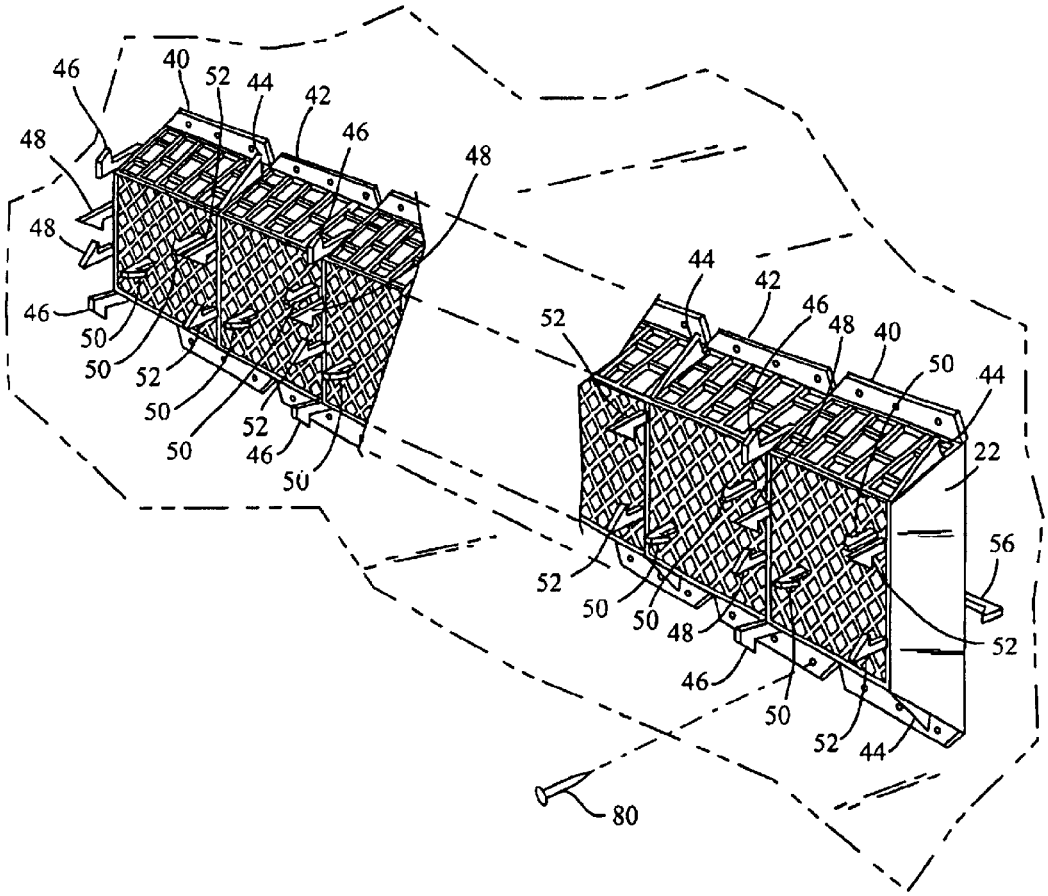
FIG. 1A—FIG. 1A depicts a perspective view of the building enhancement invention installed on a generally planar vertical surface.

Referring to FIG. 1A, the plant-on may be attached to a planar surface such as a building or dwelling using nails 80, screws or other attachment means, in the condition in which it is delivered and application of masonry materials, such as stucco, cement, plaster or adobe may begin immediately following installation, The invention may be applied to finished or unfinished surfaces.

Figure 2:
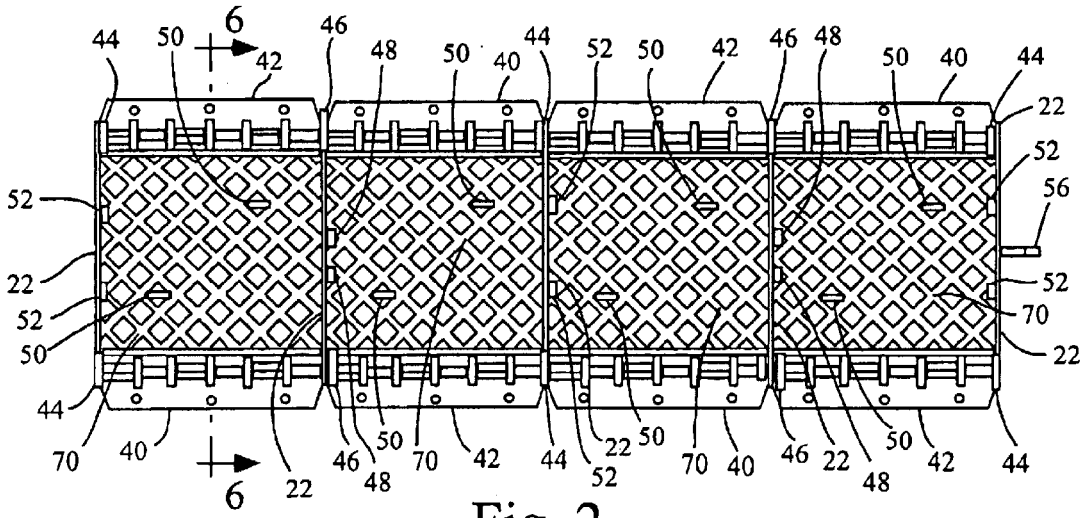
FIG. 2—FIG. 2 depicts a top view of the invention.

Referring to FIG. 2, a top view of the invention is shown where the combined sections form an inverted channel having a series of nailing holes included in the flanges 40, 42. The nailing holes are optional as an installer may prefer to attach the plant-on using a nail or screw gun which directly pierces through the flanges 40, 42 and underlying planar surface.

Alternately, the plant-on may be nailed directly through the reticulated top section 70 and attached to the building or surface beneath the plant-on.

Figure 3:
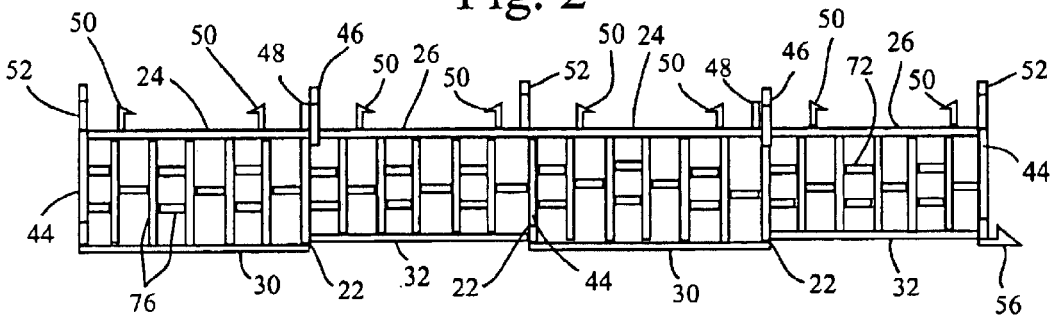
FIG. 3—FIG. 3 depicts a side view of the invention.

Referring to FIG. 3, side sections 24, 26 are shown alternating in height periodically along a lower long dimension of the plant-on. In one embodiment of the invention, the periodicity is performed in concert on both sides of the plant-on and appears as a square wave pattern along the bottom of the long dimension when viewed from either side of the plant-on. In another embodiment of the invention, the crest and troughs of the square wave patterns are opposed. The shorter side sections 26 are adjacent to the taller side sections 24. The sides of the adjacent taller side sections and the bottoms of the flanges 42 attached to the shorter side sections 26 defines a series of gaps along the bottoms 30, 32 of the long dimension of the plant-on. The gaps allows intercalation of the nailing flanges attached to a second plant-on when situated in a side-by-side arrangement with both plant-ons aligned in parallel along their long dimensions. When nail holes are included in the nailing flanges, the holes of the upper and lower intercalated flanges align to allow a nail to pass through both flanges.

At a junction of each section, the series of vertical partitions 22 are perpendicularly joined to the inner surfaces of the plant-on and periodically spaced along a long dimension of the plant-on. The partitions 22 extend vertically downward from the inner surfaces to a level equal to the bottoms of the flanges 40 attached to the taller sided sections 24 and span a width of the plant-on.

The partitions 22 provide structural support and resistance to deformation of the plant-on when applying a masonry coating. In one embodiment of the invention, the top and side edges of each partition 22 conforms to an interior profile of the plant-on.

Figure 4:
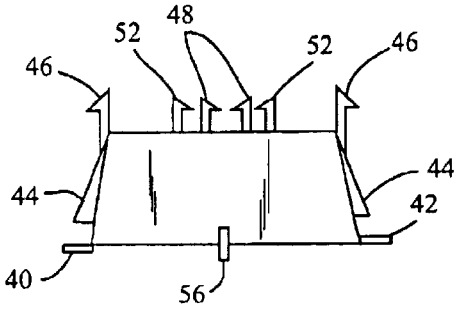
FIG. 4—FIG. 4 depicts an end view of the invention.

Referring to FIG. 4, an end view of the plant-on invention is shown which depicts the relative positions of the attachment clips 44, 46, 48, 52, 56, vertical partition 22 and flanges 40, 42.

Figure 5:
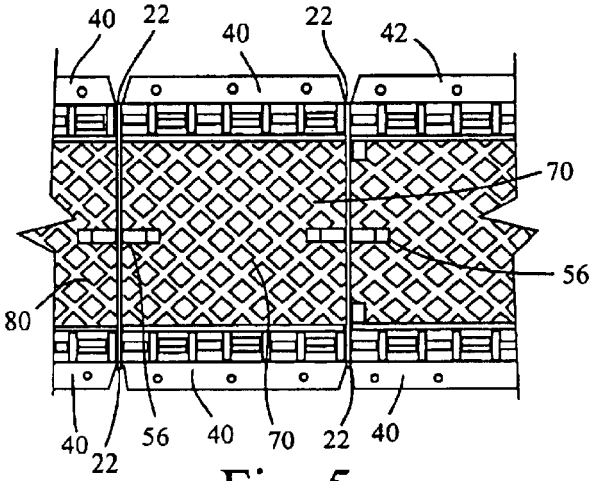
FIG. 5—FIG. 5 depicts a bottom view of the invention.

Referring to FIG. 5, a bottom view of the plant-on invention is shown which depicts the relative positions of a portion of the attachment clips 56, reticulated inner surface 70 of the top section, vertical partitions 22 and flanges 40, 42.

Figure 6:
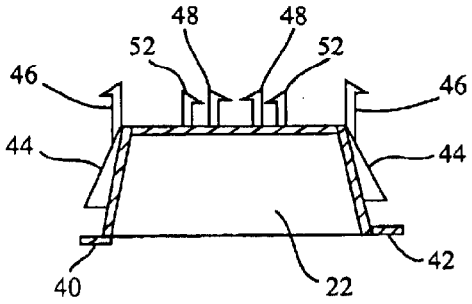
FIG. 6—FIG. 6 depicts a profile view of the invention.

Referring to FIG. 6, an example shape of the channel formed by the joined sections has a variable profile including a semi-circle, square, rectangle or trapezoid. For simplicity in the manufacturing process, the trapezoid shape is preferred. However, one skilled in the art will appreciate that other shapes including polygons, ellipses and any combination thereto may be constructed from the teachings of this disclosure as well.

Figure 7:
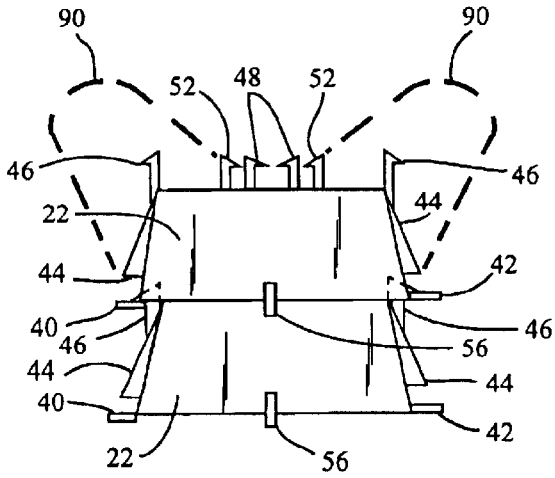
FIG. 7—FIG. 7 depicts an end view of the invention where two plant-ons are vertically stacked along a long dimension centerline with a wire mesh corner bead attached.

Referring to FIG. 7, an end view of the invention is depicted where two plant-ons are vertically stacked along a long dimension centerline with a wire mesh 90 attached to the upper wire mesh attachment clips 52 and lower wire mesh attachment clips 44. In this example, the wire mesh is shown as a corner bead 90. The modular stacking clips 46 secure one plant-on on the top of the other plant-on lengthwise at the nailing flanges 40, 42. The wire mesh 90 may be prefabricated corner bead or other wire mesh customized during installation. The modular stacking clips 46 are resilient and flex inward along the inner surface of the upper plant-on until the hook portion of the clips extend through the sides of the plant-on and engages the top surfaces of the nailing flanges 40, 42, locking the top plant-on into position above the lower plant-on.

Figure 8:
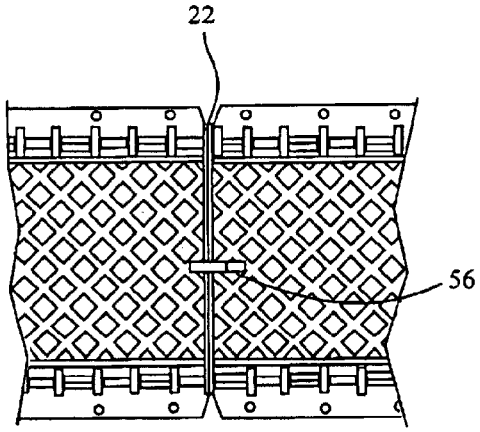
FIG. 8—FIG. 8 depicts another bottom view of the invention where two plant-ons are aligned in an end-to-end arrangement.

Referring to FIG. 8, another bottom view of the invention is depicted where two plant-ons are aligned along a centerline of a long dimension in an end-to-end arrangement. The lateral attachment clip 56 spans the vertical partitions to hold the two plant-ons together which simplifies the alignment and nailing process.

Figure 9:
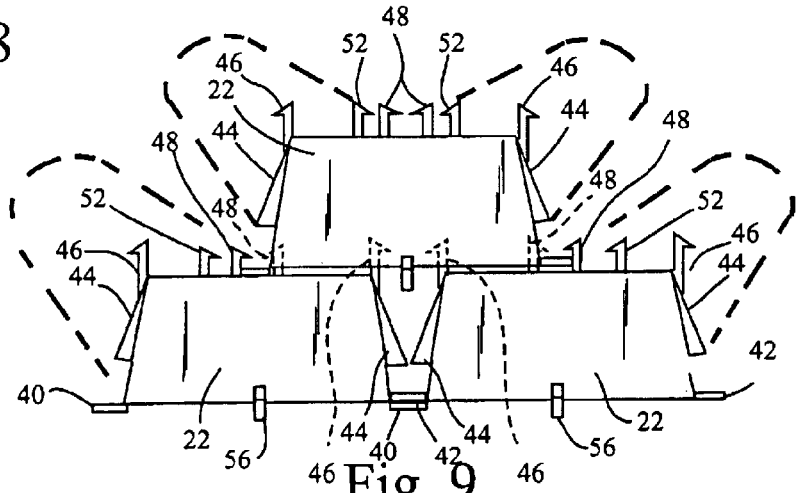
FIG. 9—FIG. 9 depicts another end view of the invention where one plant-on is vertically stacked offset from a long dimension centerline and supported by two adjacent plant-ons arranged generally in parallel along a long dimension to each other.

Lastly, referring to FIG. 9, another end view of the invention is depicted where one plant-on is vertically stacked offset from a long dimension centerline and supported by two adjacent plant-ons arranged generally in parallel along a long dimension to each other. The uppermost plant-on is secured to the lower plant-ons by the offset stacking clips 48. The offset stacking clips engage the top surfaces of the nailing flanges 40, 42. The inner offset stacking clips 48 extends through the reticulated sides 76 shown in FIG. 3 where the hook portions of the attachment clips engages the top surfaces of the nailing flanges 40, 42 from one side while the outer offset stacking clips engages the top surfaces of the nailing flanges 40, 42 from the opposite side, thus securing the upper plant-on sufficiently to apply masonry materials to the combined plant-ons.

The bottommost inner and outer offset stacking clips 48 are disposed on both sides of the nailing flanges 40, 42 associated with the topmost plant-on which allows the hook portion of the clips to lock the interceding nailing flanges 40,42 into position. Adjacent nailing flanges 40, 42 of the bottom plant-ons intercalate such that the higher nailing flange 42 overlays the lower nailing flange 40. This pattern continues along the lengths of the parallel bottom plant-ons which provides a uniform height and common nailing surfaces when placed in the configuration shown in FIG. 9.

The lower plant-ons are attached to a planar surface using the nailing flanges 40, 42. In addition, the adjacent flanges may intercalate for additional structural support as described above. The applied masonry materials provide additional structural support after hardening. Unused or excess attachment clips may be removed by cutting with a knife or saw or simply left in place and covered with masonry material. The invention is intended to be highly scissile and may be cut to a particular size using standard cutting tools used in construction such as a chop, miter saw, table saw, hand saw or clippers. The preferred embodiment of the invention is intended to be manufactured having a polygon profile in standard timber dimensions such as 2"×2", 2"×4", 2"×6", 2"×8", 2"×10", 2"×12", 4"×4", 4"×6", or 4"×8" and in lengths up to 12'. Other more customized embodiments are envisioned as well.

Operation

The customizable building plant-on is attached to a generally planar surface of a building structure in its intended permanent position, generally after preparation for application of masonry materials has been completed. The light weight of the plant-on material makes it possible for a single person to align and fasten the plant-on. After the first plant-on is attached, a second piece of plant-on is butted up against the first plant-on end. The lateral connection clips of the first plant-on retain the end section of the second plant-on. The second plant-on is then aligned and fastened. This process repeats until the corner of the building is reached by an ending plant-on. That ending plant-on is generally cut at a 45-degree angle to the perpendicular of the plant-on at the corner, then aligned and fastened. The next plant-on is generally cut at an opposite 45-degree angle to the perpendicular of the plant-on at the end, aligned with the mating corner piece and fastened. This process continues along the second surface and is repeated until the desired length of plant-on has been attached to the building using nails or screws.

The profile of the plant-on may then be customized by attaching a second layer of plant-on to the first installed plant-on. This is performed by placing a second plant-on over the first, aligning the appropriate (centerline or off-centerline) attaching clips of the first plant-on with the side sections of the second plant-on and applying force to lock the attaching clips into place Two or more plant-ons, which have been stacked, are shown in FIGS. 7 and 9. Corner bead or wire mesh should be applied to both sides of the stacked plant-ons to allow sufficient masonry material to be accumulated.

When a broad band is desired, two or more plant-ons are aligned generally in parallel to their long dimensions and positioned laterally so as to allow the flanges associated with the taller side sections to intercalate below the flanges associated with the shorter side sections. Once a desired banding pattern has been obtained, the combined bands are attached to the intended building surface as described above.

The profile of the plant-on may be customized by attaching corner bead to the lower and upper wire mesh attachment clips of the installed plant-on. Corner bead is available in different profiles, and comes as lengths of corner bead. A length may be laid over the plant-on corner from side to top surface and the wire mesh of the corner bead stretched over the lower and upper wire mesh attachment clips. This is repeated until the required portions of the plant-on are covered. The process may be repeated on the opposite corner of the plant-on, if desired.

The masonry materials used with the invention such as stucco are then applied to the plant-ons either by using a hand trowel or pneumatically. Standard masonry mixtures will work with this invention.

The foregoing described embodiments of the invention are provided as illustrations and descriptions. They are not intended to limit the invention to precise form described. In particular, it is contemplated that functional implementation of the invention described herein may be constructed of varying materials and different multi-plant-on attachment arrangements. Other variations and embodiments are possible in light of above teachings, and it is not intended that this Detailed Description limit the scope of invention, but rather by the Claims following herein.

We claim:

1. A plant-on for use in providing a raised architectural relief comprising:

an elongated top section having;
- a first end,
- a second end,
- a reticulated top outer surface,
- a reticulated top inner surface,
- a front side,
- and a rear side, an elongated front side section having;
- a reticulated front side outer surface,
- a reticulated front side inner surface,
- a first top portion joined to said front side of said top section,
- a first bottom portion having;
  - a plurality of front base sections and a plurality of vertically recessed front sections such that a front height of said first bottom portion varies periodically a pre-determined amount along a long dimension of said front side section;

an elongated rear side section having;
- a reticulated rear side outer surface,
- a reticulated rear side inner surface,
- a second top portion joined to said rear side of said top section,
- a second bottom portion having;
  - a plurality of rear base sections and a plurality of vertically recessed rear sections such that a rear height of said second bottom portion varies periodically said pre-determined amount along a long dimension of said rear side section; and a plurality of flange members having a predetermined thickness and joined substantially perpendicularly to at least said front and rear base sections and aligned in a plane generally parallel to said top inner surface.

2. The plant-on according to claim 1 wherein said top, front side and rear side inner surfaces defines an inverted channel having a reticulated inner surface and a reticulated outer surface.

3. The plant-on according to claim 2, further including a plurality of vertical partitions perpendicularly joined to said reticulated inner surface or said channel and periodically spaced along a long dimension of said channel.

4. The plant-on according to claim 3 wherein at least one of said plurality of substantially vertical partitions is connected to said channel at either said first end or said second end.

5. The plant-on according to claim 2 wherein said channel is generally porous to at least one masonry material.

6. The plant-on according to claim 1 wherein a profile of said first end or said second end includes a rectangular, square or trapezoidal shape.

7. The plant-on according to claim 1 wherein said plurality of vertically recessed front sections and said plurality of vertically recessed rear sections varies periodically in concert but out of phase along said long dimension of said channel.

8. The plant-on according to claim 1 further including a plurality of attachment means disposed periodically along a long dimension of said elongated top, front side and rear side sections.

9. The plant-on according to claim 8 wherein said plurality of attachment means includes means for vertically stacking another plant-on aligned along a centerline of said long dimension.

10. The plant-on according to claim 8 wherein said plurality of attachment means includes means for vertically stacking another plant-on aligned offset from a centerline of said long dimension.

11. The plant-on according to claim 8 wherein said plurality of attachment means includes means for horizontally connecting another plant-on aligned along a centerline of said long dimension such that each of said connected plant-ons are uniformly aligned in at least a first end to a second end arrangement.

12. The plant-on according to claim 8 wherein said attachment means further includes means for attaching a wire mesh to said elongated top section and said elongated front side section, such that said wire mesh covers at least a portion of said elongated front side section.

13. The plant-on according to claim 8 wherein said attachment means further includes means for attaching a wire mesh to said elongated top section and said elongated rear side section, such that said wire mesh covers at least a portion of said elongated rear side section.

14. The plant-on according to claim 1 wherein said predetermined thickness of said plurality of flange members is less than said predetermine amount.

15. The plant-on according to claim 14 wherein said plurality of flange members includes means for intercalating with another plant-on aligned substantially in parallel to a long dimension of said front side section.

16. The plant-on according to claim 14 wherein said plurality of flange members includes mans for intercalating with another plant-on aligned substantially in parallel to a long dimension of said rear side section.

17. The plant-on according to claim 1 wherein said plurality of flange members includes means for attaching said plant-on to a generally planar surface.

18. The plant-on according to claim 1 wherein said plant-on is constructed from either a composite wood matrix or polymeric materials.

19. The plant-on according to claim 5 wherein said channel includes an etched finish on at least said top outer surface to improve adherence of said at least one masonry material.

20. A plant-on constructed of polymeric materials for use in providing a raised architectural relief comprising:

an elongated top section having;

a first end, a second end, an etched and reticulated top outer surface, a reticulated top inner surface, a front side, and a rear side, an elongated front side section having;

a reticulated front side outer surface, a reticulated front side inner surface, a first top portion joined lo said front side of said top section, a first bottom portion having;

a plurality of front base sections and a plurality of vertically recessed front sections such that a front height of said first bottom portion varies periodically a pre-determined amount along a long dimension of said front side section;

an elongated rear side section having;

a reticulated rear side outer surface, a reticulated rear side inner surface, a second top portion joined to said rear side of said top section, a second bottom portion having; a plurality of rear base sections and a plurality of vertically recessed rear sections such that a rear height of said second bottom portion varies periodically by said pre-determined amount along a long dimension of said rear side section in concert but out of phase with said front base sections;

a plurality of flange members having a vertical height less than said pre-determined amount and joined substantially perpendicularly to at least said front and rear base sections and aligned in a plane generally parallel to said top inner surface;

a plurality of attachment means disposed periodically along a long dimension of said elongated top, front side and rear side sections; and a plurality of substantially vertical partitions perpendicularly joined to said elongated top, front side and rear side sections inner surfaces and periodically spaced along a long dimension of said plant-on.

21. The plant-on according to claim 20 wherein said plurality of attachment means includes means for vertically stacking another plant-on aligned along a centerline of said long dimension.

22. To plant-on according to claim 20 wherein said plurality of attachment means includes means for vertically slacking another plant-on aligned offset from a centerline of said long dimension.

23. The plant-on according to claim 20 wherein said plurality of attachment means includes means for horizontally connecting another plant-on aligned along a centerline of said long dimension such that each of said connected plant-ons are uniformly aligned in at least a first end to a second end arrangement.

24. The plant-on according to claim 20 wherein said plurality of attachment means includes means for horizontally connecting another plant-on aligned along either said front or rear side of said plant-on such that said another plant-on is aligned substantially in parallel to said plant-on.

25. The plant-on according to claim 20 wherein a profile of said first end or said second end includes a square, a rectangular, or a trapezoidal shape.

26. The plant-on according to claim 20 wherein said plant-on is generally porous to at least one masonry material.

27. The plant-on according to claim 20 wherein said attachment means further includes means for attaching a wire mesh to cover at least a portion of said front or said rear side sections.

* * * * *